US010604286B2

(12) United States Patent
Nelson

(10) Patent No.: US 10,604,286 B2
(45) Date of Patent: Mar. 31, 2020

(54) TOOL FOR TIGHTENING STRAPPING

(71) Applicant: Encore Packaging LLC, Lake Bluff, IL (US)

(72) Inventor: Timothy H. Nelson, Winnetka, IL (US)

(73) Assignee: Encore Packaging LLC, Vernon Hills, IL (US)

( * ) Notice: Subject to any disclaimer, the term of this patent is extended or adjusted under 35 U.S.C. 154(b) by 1271 days.

(21) Appl. No.: 14/707,093

(22) Filed: May 8, 2015

(65) Prior Publication Data

US 2015/0321776 A1 Nov. 12, 2015

Related U.S. Application Data

(60) Provisional application No. 62/113,012, filed on Feb. 6, 2015, provisional application No. 61/990,494, filed on May 8, 2014.

(51) Int. Cl.

| | |
|---|---|
| ***B65B 13/02*** | (2006.01) |
| ***B65B 13/30*** | (2006.01) |
| ***B65B 13/22*** | (2006.01) |
| ***B65B 13/34*** | (2006.01) |
| ***B65B 27/10*** | (2006.01) |

(52) U.S. Cl.

CPC ..... *B65B 13/22* (2013.01); *B65B 13/025* (2013.01); *B65B 13/027* (2013.01); *B65B 13/30* (2013.01); *B65B 13/345* (2013.01); *B65B 27/10* (2013.01)

(58) Field of Classification Search

CPC ..... B65B 13/22; B65B 13/025; B65B 13/027; B65B 13/185; B65B 13/187; B65B 13/30; B65B 13/345

USPC ..... 100/29, 32; 242/118, 419.4, 419.8, 242/419.9, 586.4

See application file for complete search history.

(56) References Cited

U.S. PATENT DOCUMENTS

| | | | | |
|---|---|---|---|---|
| 2,882,934 | A * | 4/1959 | Gerrard | B65B 13/025 140/123.6 |
| 3,545,723 | A * | 12/1970 | Raley | B65B 13/025 254/253 |
| 3,612,481 | A * | 10/1971 | Guy | B65B 13/025 140/93.4 |
| 4,252,158 | A * | 2/1981 | McDade | B65B 13/025 140/123.6 |
| 6,962,108 | B1 * | 11/2005 | Yu Chen | B65B 13/025 100/29 |
| 7,438,094 | B2 * | 10/2008 | Hillegonds | B21F 9/02 100/30 |
| 7,669,526 | B2 * | 3/2010 | Fay | B65B 13/185 100/32 |
| 2007/0169833 | A1 * | 7/2007 | Crittenden | B65B 13/025 140/123.6 |
| 2009/0158942 | A1 * | 6/2009 | Barlosov | B65B 13/025 100/6 |

(Continued)

*Primary Examiner* — Jimmy T Nguyen

(74) *Attorney, Agent, or Firm* — Fitch, Even, Tabin & Flannery LLP

(57) ABSTRACT

A clamping device is mounted to the pusher tensioner to clamp a portion of strapping to be applied to a load during tensioning of an opposite end of the strapping. In one example, the clamping device includes a clamping plate mounted to define a clamping space between the clamping plate and a portion of the pusher tensioner. A metal seal having a pusher sealer configuration with serrations on inner surfaces of the metal seal can be used with the tool to secure plastic strapping.

8 Claims, 10 Drawing Sheets

(56) References Cited

U.S. PATENT DOCUMENTS

2010/0132827 A1* 6/2010 Yu Chen ..... B65B 13/025
140/152

* cited by examiner

TOOL FOR TIGHTENING STRAPPING

RELATED APPLICATIONS

This application claims the benefit of U.S. provisional patent application No. 62/113,012 filed Feb. 6, 2015, and U.S. provisional patent application No. 61/990,494 filed May 8, 2014, both of which are incorporated by reference herein in their entireties.

TECHNICAL FIELD

The invention relates generally to the packaging industry and, more specifically, to tools for tightening strapping around a secured object.

BACKGROUND

Metal seals, both smooth and serrated, are known and used for securing strapping around an object, for example, for securing an object to a pallet for shipping. The strapping is typically a flat metal or plastic strap less than an inch wide. The seal is typically a metal seal that is crimped around two ends of the strap, in effect tying the two ends together in securing the strap to an object. Various tools are known for tightening the strapping around the object to be secured. In one example, a tool known as the pusher tensioner attaches to and pulls a free end of the strapping while an end of the tool holds and pushes the seal along the pulled strapping. A separate crimping tool pinches the metal seal to crimp the seal around the strapping to securely attach the two ends of the strapping to each other.

When used with metal strapping, such pusher tensioner tools are effective because a second end of the strapping not pulled by the tool can be bent back over the metal seal sufficiently holding that end of the strapping in place while tightening and sealing the other end of the strapping around the object. Plastic strapping, such as polyester strapping, is generally considered safer and less expensive such that it has taken over a lot of the market where steel strapping was used. Plastic strapping, however, has not replaced steel strapping in the round bundling market, for example, for tubing, because the second end of the plastic strapping slips through the metal seal when the pusher tensioner tightens the first end.

SUMMARY

Generally speaking and pursuant to these various embodiments, a clamping device is mounted to the pusher tensioner. The clamping device clamps a clamped portion of the strapping between ends of the strapping to be sealed by the metal seal. Although other clamping devices are possible, in one example, the clamping device includes a clamping plate mounted to define a clamping space between the clamping plate and a portion of the pusher tensioner. At least one of the clamping plate and the portion of the pusher tensioner defines at least one groove facing the clamping space. A ball bearing in the groove engages the clamped portion of the strapping by pinching the clamped portion of the strapping between the ball bearing and the surface opposite the groove. The groove may be sloped to have a declining depth in a direction of shifting of the clamped portion of the strapping during tightening of the strapping such that the shifting of the strapping forces the ball bearing into a portion of the groove having the declining depth thereby tightening the clamping effect on the strapping.

In another example clamping device, a clamping member is mounted relative to the clamping space and configured to move between a first position and a second position. The the first position, the clamping member allows room to place a portion of the strapping in the clamping space. In the second position, the clamping member clamps the strapping in the clamping space to prevent movement of the strapping relative to the clamping space. An actuator moves the rotatable clamping member between the first position and the second position in response to actuation of the actuator. The clamping member can come in a variety of forms. In one, the member is a rod that rotates about its longitudinal axis, and rotation of the rod rotates an engaging surface disposed on the rod into the clamping space to clamp the strapping. The engaging surface may be a flat portion of the rod such that one end of the flat portion rotates with the rod to engage the strapping.

So configured, the plastic strapping is held in place during the tightening process, which allows use of the generally cheaper and safer plastic strapping in round bundling applications. With a tool that can hold plastic strapping in place while tightening the strapping, a metal seal having a pusher sealer configuration can be used with the plastic strapping if it has serrations on inner surfaces of the metal seal. These and other benefits may become clearer upon making a thorough review and study of the following detailed description.

BRIEF DESCRIPTION OF THE DRAWINGS

The above needs are at least partially met through provision of the tool for tightening strapping described in the following detailed description, particularly when studied in conjunction with the drawings, wherein.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Figure 1:
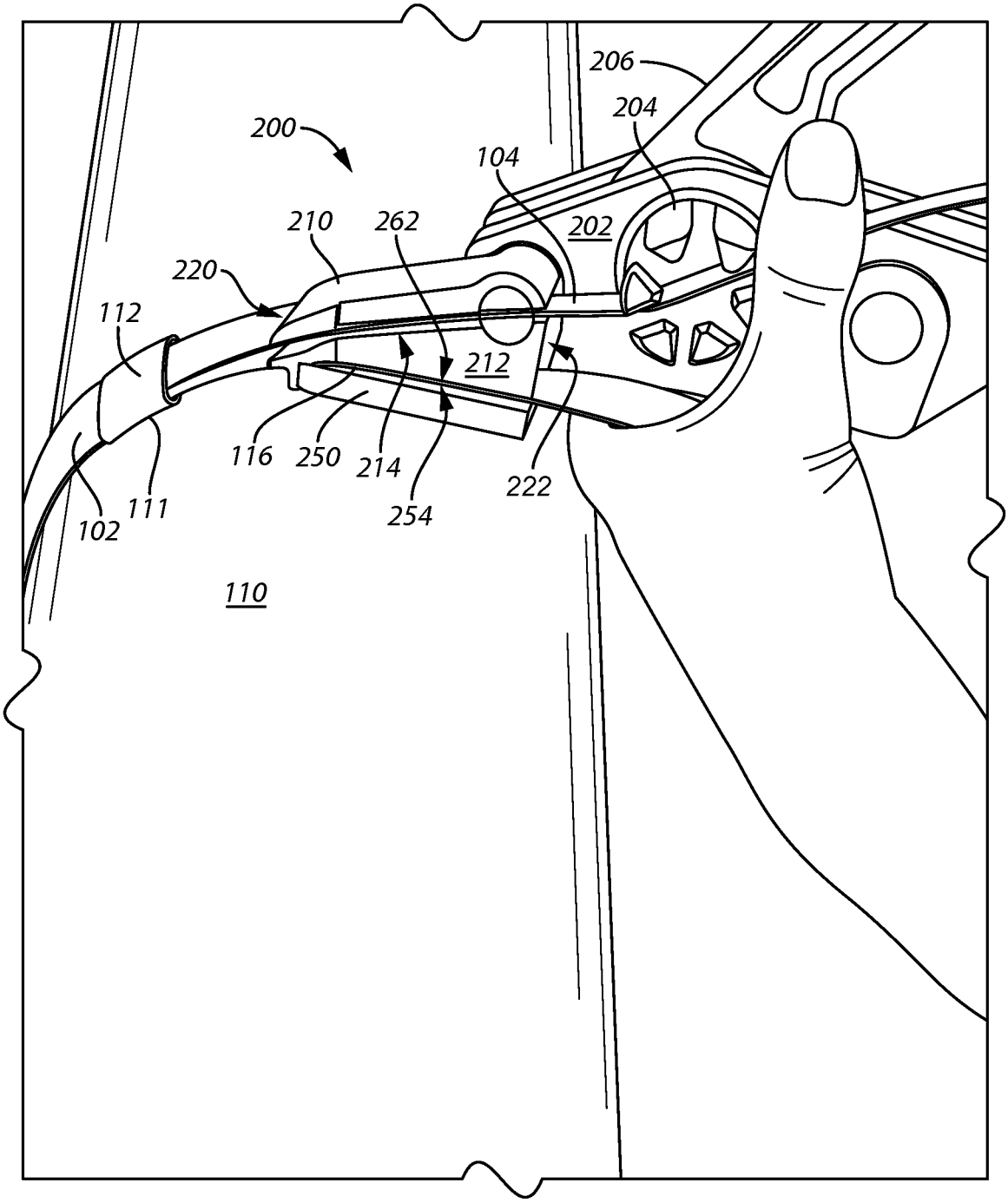
FIG. 1 comprises a perspective view of an example pusher tensioner with a clamping device during an initial set up with plastic strapping in accordance with various embodiments of the invention.
Figure 2:
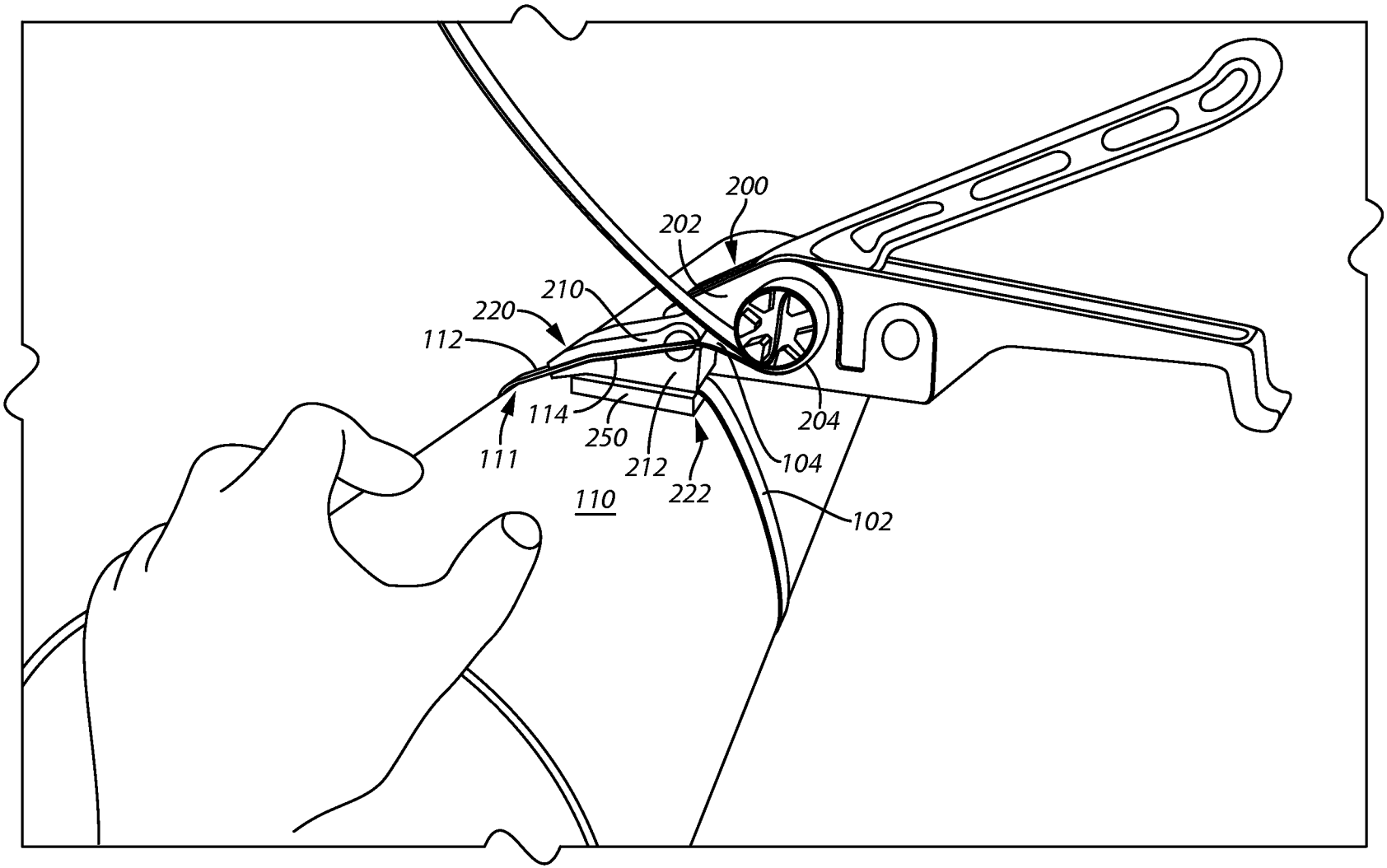
FIG. 2 comprises a perspective view of the example pusher tensioner with clamping device of FIG. 1 after tightening the plastic strapping.

Referring now to the drawings and, in particular to FIGS. 1 and 2, an example apparatus for securing plastic or metal strapping around an object will be described. A plastic strapping 102 is secured to itself around the object 110 at a sealing point 111 via a metal seal 112. The strapping 102 has a free end 104 extending past the sealing point 111 and not connected at the sealing point 111.

A pusher tensioner 200 tensions the free end 104 of the strapping 102. In the illustrated example, the pusher tensioner 200 includes a body 202 and a toothed wheel 204 pivotally mounted in relation to the body 202. A lever 206 is connected to rotate the toothed wheel 204 in response to the lever's 206 being moved in a first direction relative to the body 202 and to not rotate the toothed wheel 204 in response to the lever's 206 being moved in a second direction relative to the body 202, where the first direction is different from the second direction. A first receiving plate 210 and a second receiving plate 212 are mounted to the body 202 in a spaced relationship to define a space 214 between the first receiving plate 210 and the second receiving plate 212 sized to guide the strapping 102 from a first end 220 of the first receiving plate 210 and the second receiving plate 212 to a second end 222 of the first receiving plate 210 and the second receiving plate 212. The second end 222 of the first receiving plate 210 and the second receiving plate 212 is disposed opposite from the first end 220 of the first receiving plate 210 and the second receiving plate 212 and spaced relative to the toothed wheel 204 to guide the free end 104 of the strapping 102 to the toothed wheel 204. As illustrated in FIG. 2, by extending between teeth of the toothed wheel 204, the free end 104 of the strapping 102 wraps around the outer edges of the toothed wheel 204 as it rotates in response to movement of the lever 206. This wrapping action pulls the strapping tightly around the object 110 while the first end 220 of the first receiving plate 210 and the second receiving plate 212 engage the metal seal 112 to hold it in relation to the object and second end of the strapping.

A clamping device mounts to the pusher tensioner 200 to clamp a clamped portion 116 of the strapping 102 between ends of the strapping 102 to be sealed at the sealing point 111 adjacent to the object 110. Although any of a variety of clamping devices can be used, in the illustrated example, the clamping device includes a clamping plate 250 mounted to define a clamping space 254 between the clamping plate 250 and a portion 262 of the pusher tensioner 200. In the illustrated example, this portion 262 of the pusher tensioner 200 is an outside surface of the second receiving plate 212. Optionally, a portion of the clamping plate 250 at the first end 220 of the pusher tensioner 200 is tapered to facilitate engagement of the strapping and the object during tensioning.

Figure 3:
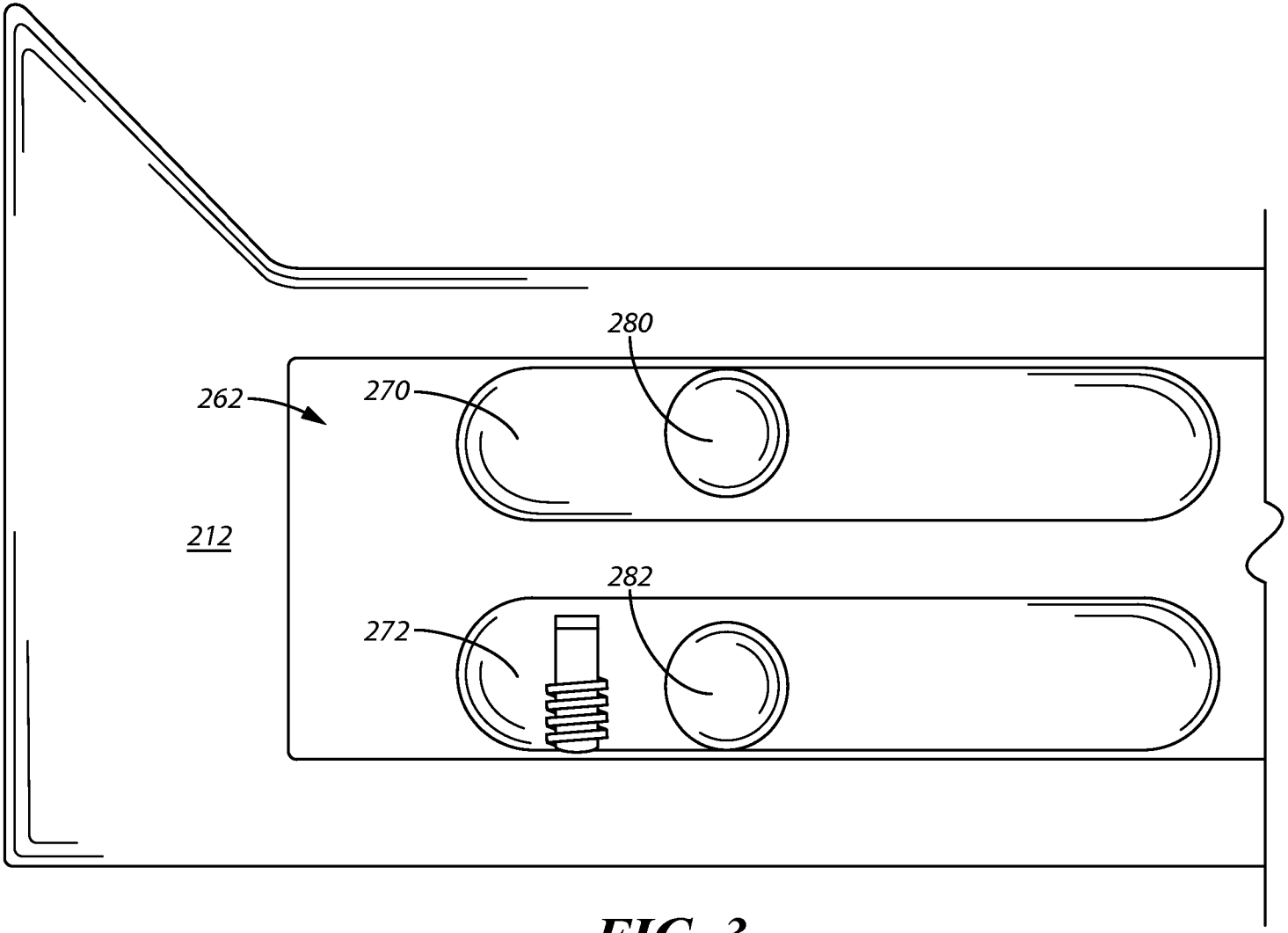
FIG. 3 comprises a bottom view of an example portion of a pusher tensioner having grooves and ball bearings in accordance with various embodiments of the invention.
Figure 4:
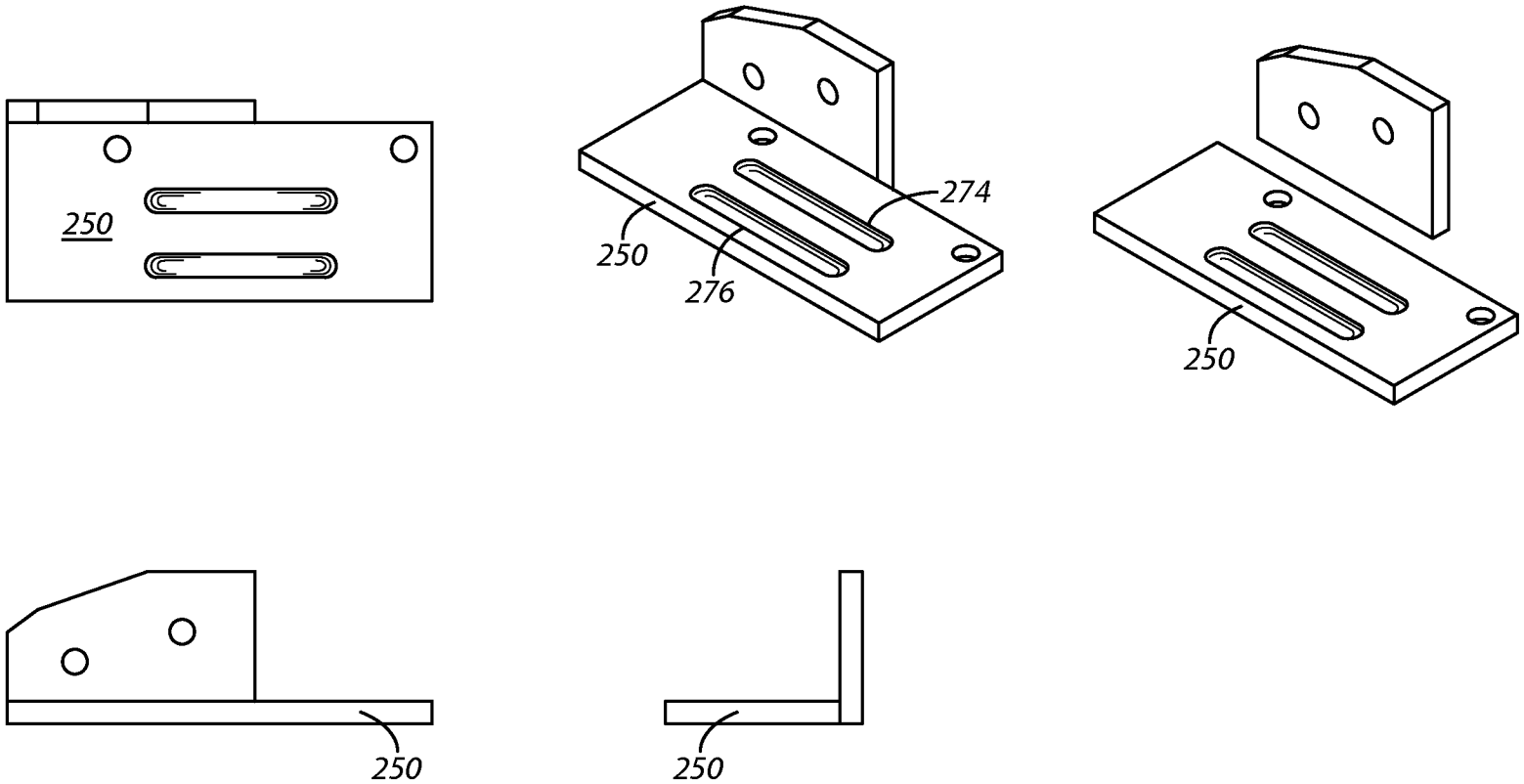
FIG. 4 comprises a set of engineering drawings of an example clamping plate and connecting plate for securing the clamping plate to a pusher tensioner as configured in accordance with various embodiments of the invention.
Figure 5:
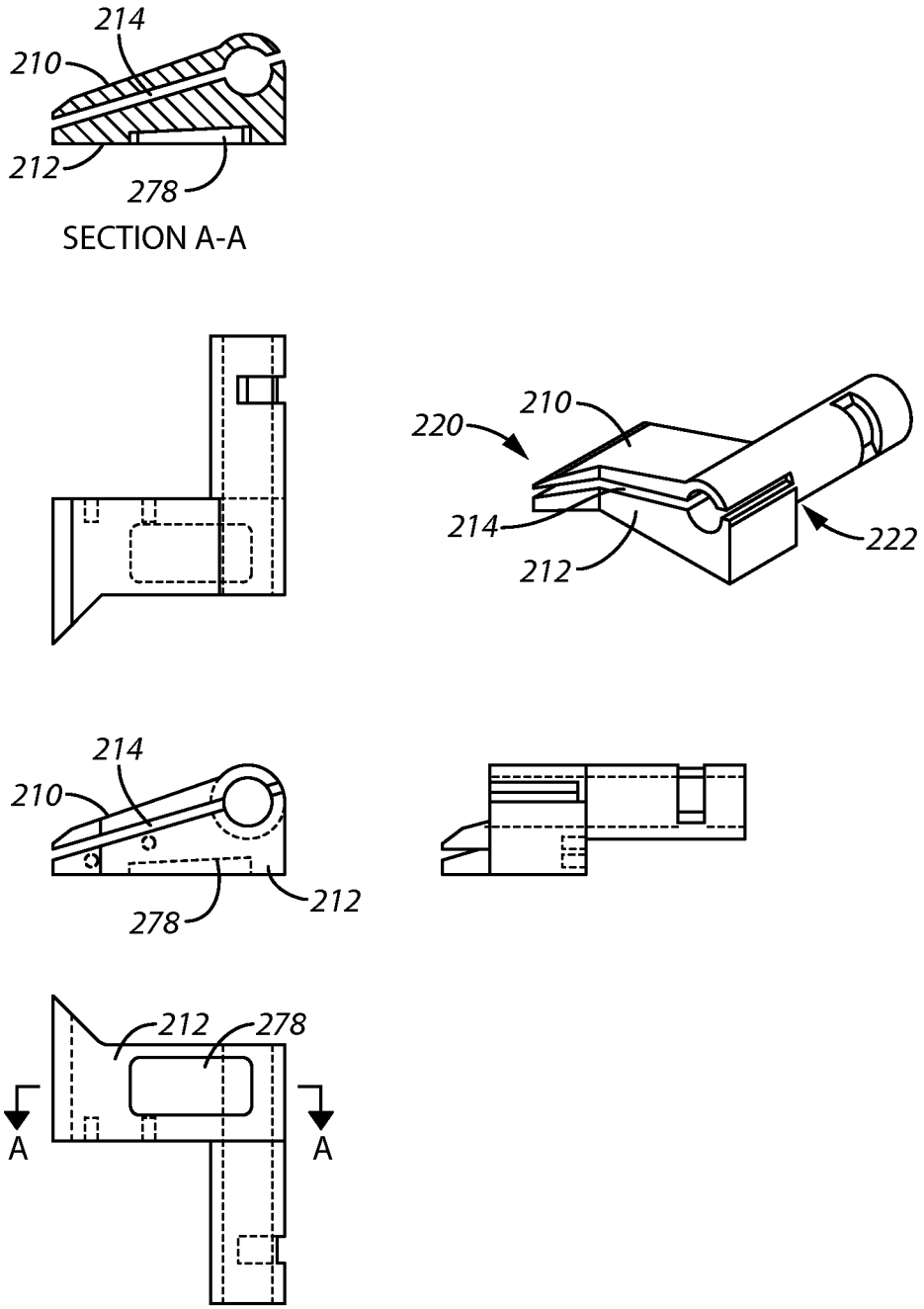
FIG. 5 comprises a set of engineering drawings of example first and second plates of a pusher tensioner as configured in accordance with various embodiments of the invention.

Referring to FIGS. 3 and 4, at least one of the clamping plate 250 and the portion 262 of the pusher tensioner 200 defines at least one groove 270, 272, 274, 276, 278 facing the clamping space 254. The at least one groove 270, 272, 274, 276, 278 is sized to receive a ball bearing 280, 282 having a width larger than the groove's 270, 272, 274, 276, 278 depth and larger than the clamping space 254 (to keep the ball bearing 280, 282 in the groove) such that the ball bearing 280, 282 is spaced from a surface opposite the groove 270, 272, 274, 276, 278 to engage the clamped portion 116 of the strapping 102. Thus, if the groove 274, 276 is in the clamping plate 250, the strapping 102 is engaged between the ball bearing 280, 282 and the pusher tensioner 200, and in the illustrated example, between the outside surface of the second receiving plate 212 of the pusher tensioner 200. If the groove 270, 272, 278 is in the second receiving plate 212, the strapping 102 is engaged between the ball bearing 280, 282 and the clamping plate 250. The groove 270, 272, 274, 276, 278 may be sloped to have a declining depth (see FIG. 5) in a direction of shifting of the clamped portion 116 of the strapping 102 during tightening of the strapping 102 such that the shifting of the clamped portion 102 of the strapping 102 forces the ball bearing 280, 282 into a portion of the groove 270, 272, 274, 276, 278 having the declining depth. The shifting of the clamped portion 116 of the strapping 102 forces the ball bearing 280, 282 into a portion of the groove 270, 272, 274, 276, 278 having the declining depth to pinch the clamped portion 116 of the strapping 102 between the ball bearing 280, 282 and the surface opposite the groove 270, 272, 274, 276, 278. Because the pusher tensioner will advance the apparatus including the clamping device toward the metal seal during tightening of the strapping, the groove 270, 272, 274, 276, 278 will typically decline in depth in a direction toward the first end 220 of the second receiving plate 212.

Another example clamping device will be described with reference to FIGS. 6-8. Similar to the example above, the illustrated pusher tensioner 600 tensions the free end 104 of the strapping. In the illustrated example, the pusher tensioner 600 includes a body 602 and a toothed wheel 604 pivotally mounted in relation to the body 602. A lever 606 is connected to rotate the toothed wheel 604 in response to the lever's 606 being moved in a first direction relative to the body 602 and to not rotate the toothed wheel 604 in response to the lever's 606 being moved in a second direction relative to the body 602, where the first direction is different from the second direction Like the example described above, first receiving plate 610 and a second receiving plate 612 are mounted to the body 602 in a spaced relationship to define a space 614 between the first receiving plate 610 and the second receiving plate 612 sized to guide the strapping from a first end 620 of the first receiving plate 610 and the second receiving plate 612 to a second end of the first receiving plate 610 and the second receiving plate 612 towards the toothed wheel 604 to guide the free end 104 of the strapping to the toothed wheel 604.

The clamping device of this example mounts to the pusher tensioner 600 to clamp a clamped portion 116 of the strapping between ends of the strapping to be sealed at the sealing point adjacent to the object. In example of FIGS. 6-8, the clamping device includes a clamping plate 650 mounted to define a clamping space 654 between the clamping plate 650 and a portion 662 of the pusher tensioner 600. In the illustrated example, this portion 662 of the pusher tensioner 600 is an outside surface of the second receiving plate 612. Optionally, a portion of the clamping plate 650 at the first end 620 of the pusher tensioner 600 is tapered to facilitate engagement of the strapping and the object during tensioning.

Figure 6:
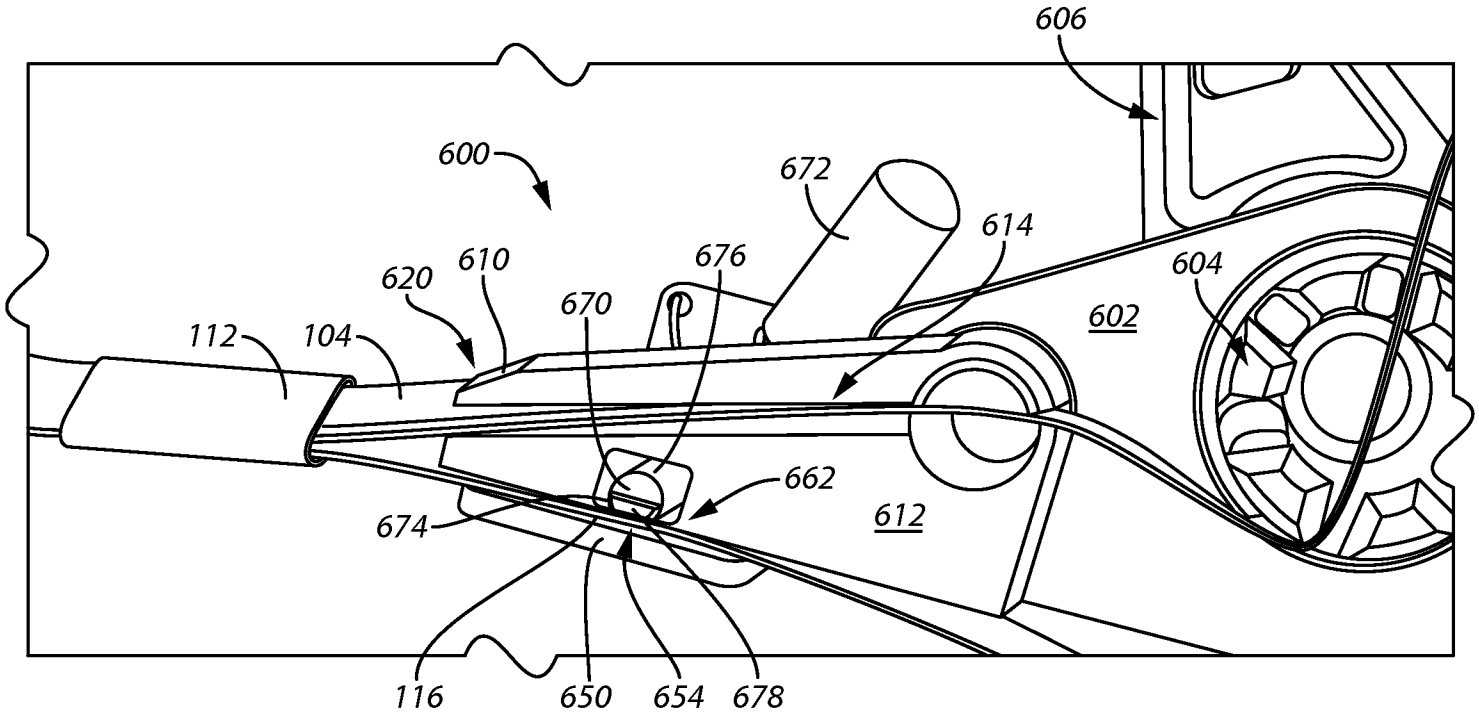
FIG. 6 comprises a side view of an example pusher tensioner with a clamping device having a movable clamping member during an initial set up with plastic strapping in accordance with various embodiments of the invention.
Figure 7:
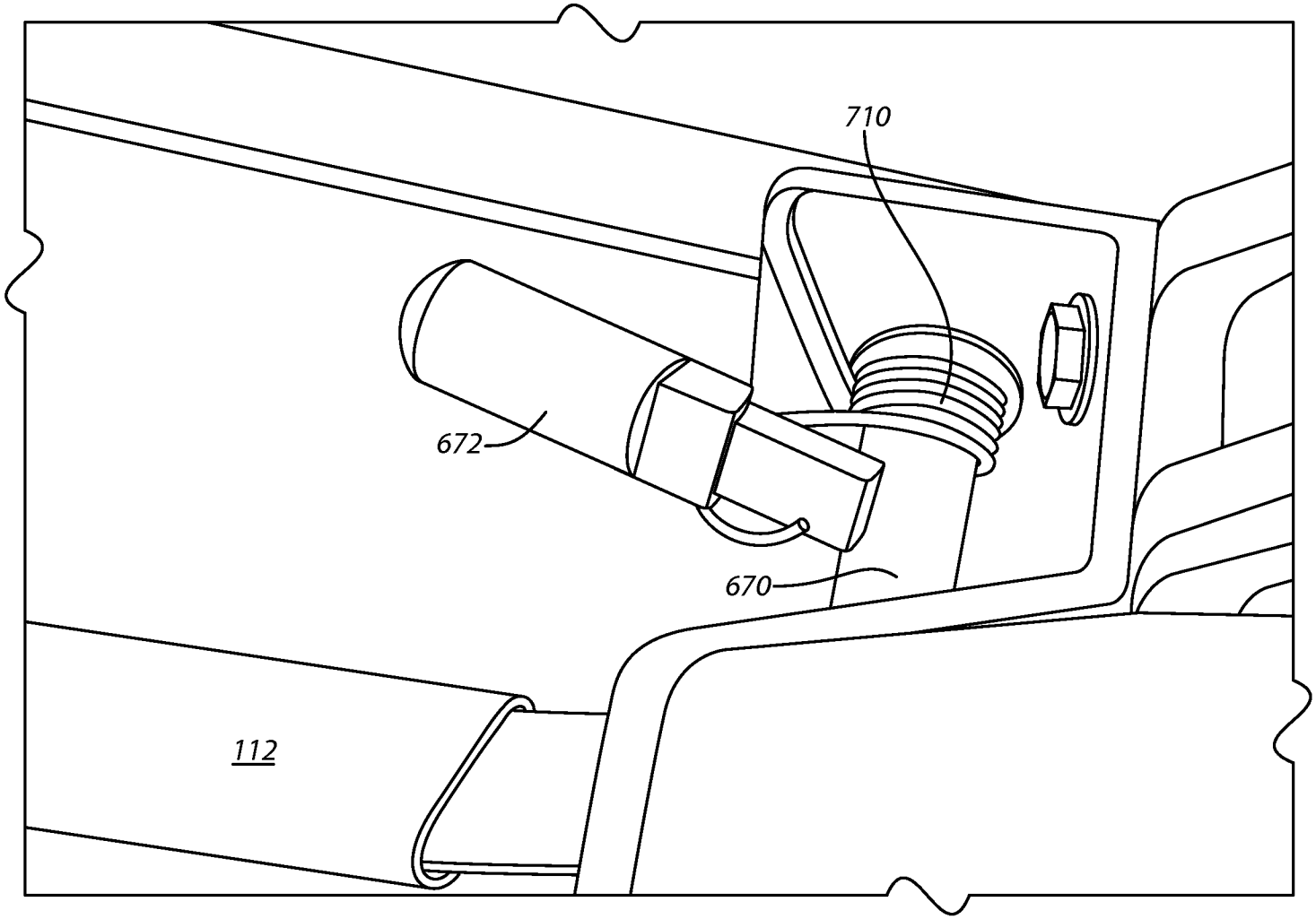
FIG. 7 comprises a top view of a portion of the example pusher tensioner of FIG. 6 showing an actuator for moving the clamping device in accordance with various embodiments of the invention.
Figure 8:
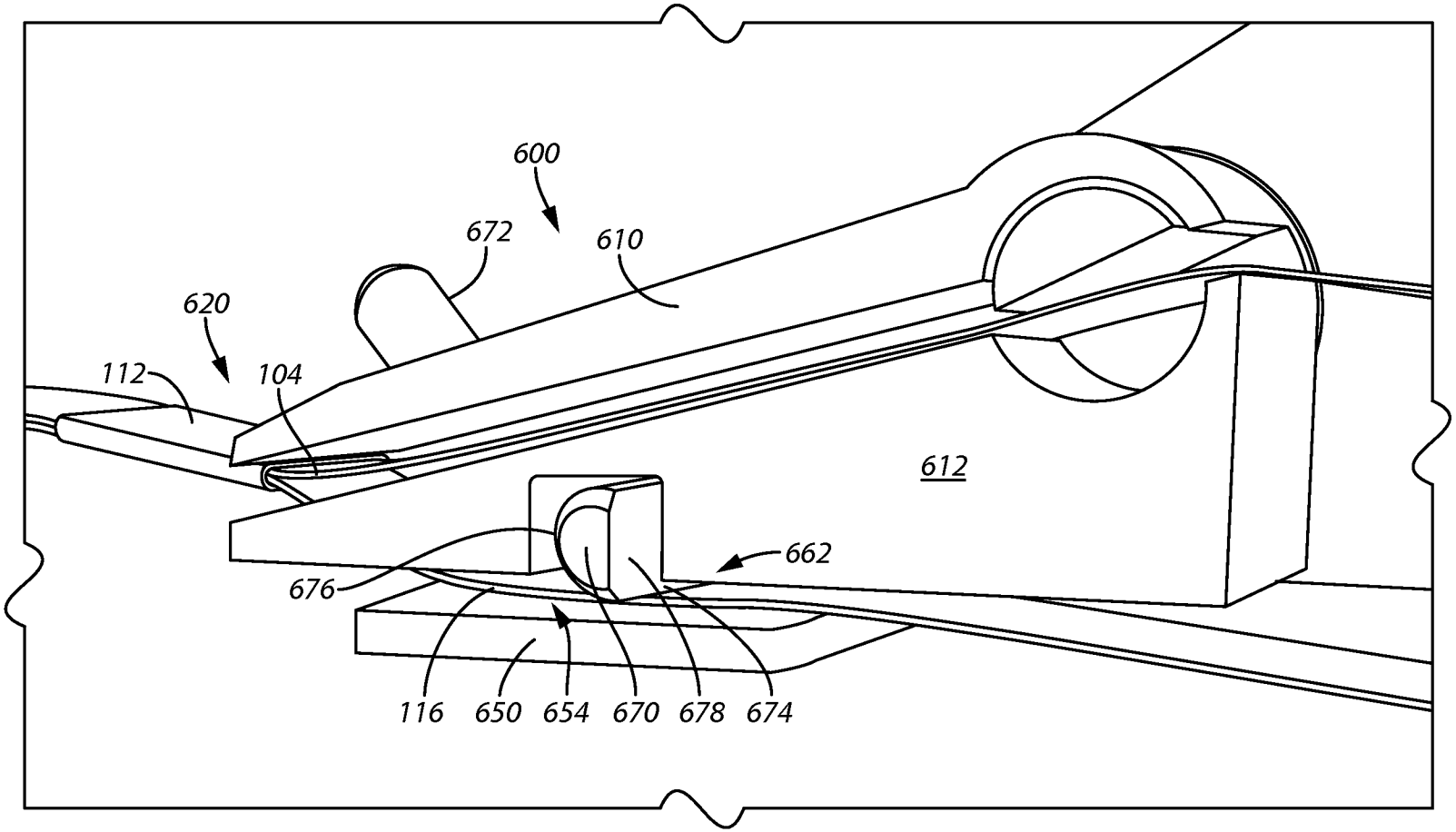
FIG. 8 comprises a side view of the example pusher tensioner of FIG. 6 with the movable clamping member engaging plastic strapping in accordance with various embodiments of the invention.

A clamping member 670 is mounted relative to the clamping space 654 and moves between a first position illustrated in FIG. 6 and a second position illustrated in FIG. 8. In the first position, the clamping member 670 allows room to place a portion of the strapping 116 in the clamping space 654. In the second position, when the portion of the strapping 116 is in the clamping space 654, the clamping member 670 clamps the strapping 116 in the clamping space 654 to prevent movement of the strapping 116 relative to the clamping space 654. An actuator 674 is mounted to move the clamping member 670 between the first position and the second position in response to actuation of the actuator 674. In the example illustrated in FIG. 7, the actuator 674 is a lever securely attached to the clamping member to move the member with movement of the lever.

In one approach, the clamping member 670 is a rod mounted to rotate in response to actuation of the actuator 672. The rod extends across the clamping space 654 and thus the strapping 116 and defines an engaging surface 674 disposed on the rod so as to rotate into the clamping space 654 to engage the strapping 116 when the rod moves to the second position. The rod is rounded about a portion 676 of its circumference, and the engaging surface 674 is defined by a generally flat portion 678 of another part of the rod's circumference. In other approaches, the engaging surface can be a nub or other extension from the rod that can rotate into and out of the clamping space with rotation of the rod. Referring again to FIG. 7, the actuator 674 is a lever securely attached to the rod to rotate the rod with movement of the lever thereby rotating the engaging surface 674 into and out of engagement with the strapping. The lever is optionally biased with a spring 710 toward either the first position or second position, depending on the spring's 710 configuration.

So configured, plastic strapping can be securely held in place while tightening the strapping around an object and maintain the tension until the metal seal is crimped to seal the strapping to the object. The clamping plate provides a spacing between the metal seal and the object sufficient to allow a crimping tool to crimp the metal seal thereby securing the strapping. Accordingly, plastic strapping can be used to secure round objects instead of metal strapping.

In a further aspect, where the tool can hold plastic strapping during tightening, a metal seal having a pusher sealer configuration can be used with serrations on inner surfaces of the metal seal. As known in the art, serrated seals have a long flange and a short flange to facilitate engagement of the plastic strapping by the serrations on the long flange. These serrated metal seals having one extended flange and a short flange, however, cannot be used with pusher tools with their configuration. When using a pusher tool/tensioning device as that described herein, the tensioning device can engage a metal seal having a pusher sealer configuration with serrations on inner surfaces of the metal seal to crimp the metal seal to clamp plastic strapping.

Figure 9:
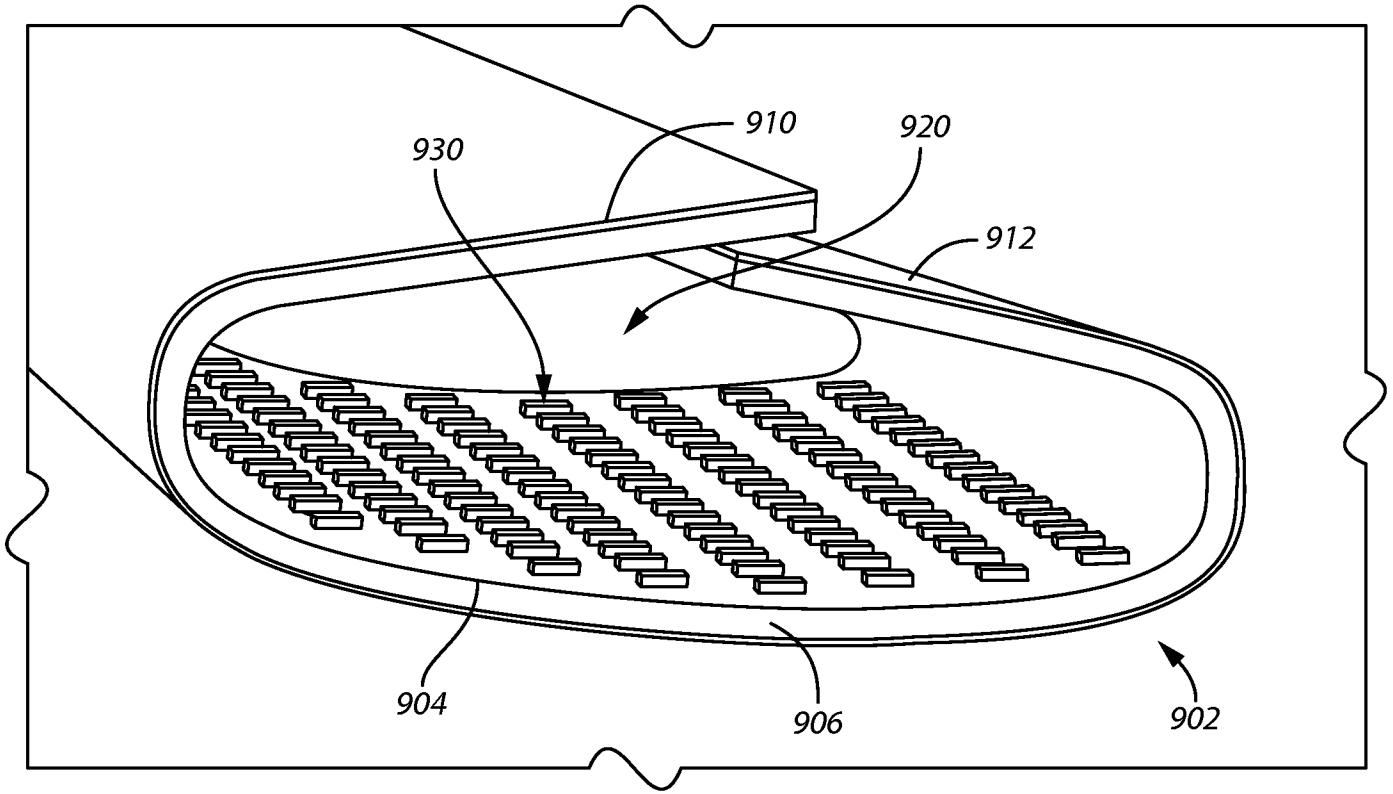
FIG. 9 comprises a view of an example metal seal having a pusher sealer configuration with serrations on inner surfaces of the metal seal in accordance with various embodiments of the invention.

An example metal seal having a pusher sealer configuration with serrations is illustrated in FIG. 9. The metal seal 902 is defined by a metal sheet 904 bent to have a base portion 906 and two flanges 910 and 912 bent toward each other to define a strapping engaging aperture 920. The aperture 920 has a width approximating and slightly bigger than strapping to be secured with the seal 902. The two flanges 910 and 912 have approximately equal lengths L to just overlap about halfway across the width. The surfaces of the metal sheet 902 inwardly facing toward the strapping engaging aperture 920 are serrated 930 so as to have notches that facilitate gripping the plastic strapping. Previous pusher metal seals do not use serrations because they rely on deformation of the metal strapping during crimping of the metal seal to bind the metal strapping. So configured with the serrations, the metal seal 902 is suitable for use with and crimping by a pusher tensioner to secure plastic strapping.

Figure 10:
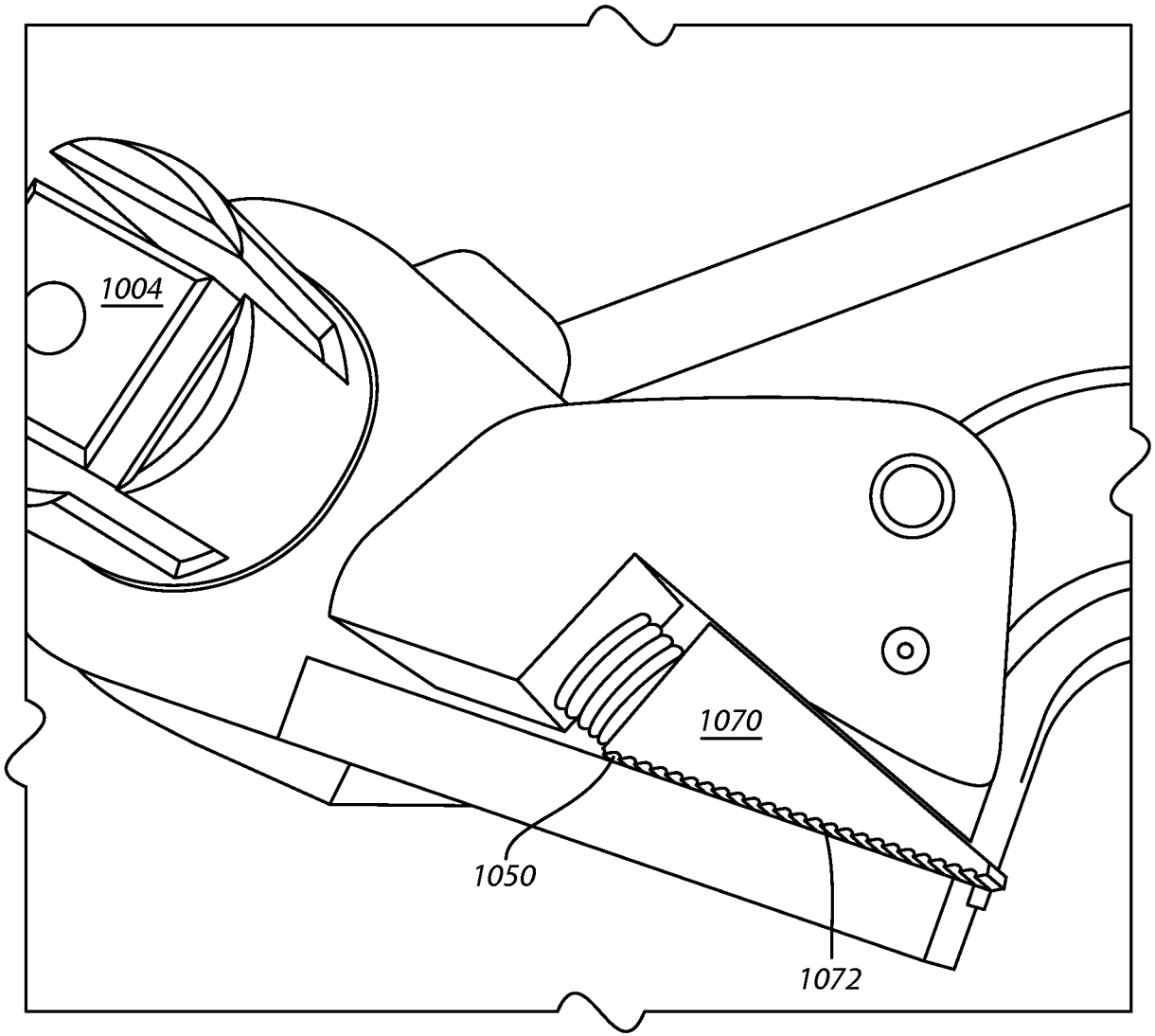
FIG. 10 comprises a side view of an example pusher tensioner with another clamping device in accordance with various embodiments of the invention.

Those skilled in the art will recognize that a wide variety of modifications, alterations, and combinations can be made with respect to the above described embodiments without departing from the scope of the invention. For instance, other mechanical configurations for moving into and out of the clamping space to clamp the strapping are possible. Another example is having gripper foot 1070 such as the example illustrated in FIG. 10 disposed to grip the strapping against the pusher tool or next to the pusher tool. The gripper foot 1070 includes a rough or other surface 1072 disposed to face and engage the strapping to provide sufficient friction to hold plastic strapping in place against an opposing surface (such as the pusher tool's bottom surface or another surface 1050) that defines the clamping space with the gripper foot 1070. The gripper foot 1070 can be actuated by an actuator like the lever of FIG. 7 or using other known mechanical approaches to engage and lock against the strapping to prevent slippage during tightening of the strapping. Such modifications, alterations, and combinations are to be viewed as being within the ambit of the inventive concept.

What is claimed is:

1. An apparatus for securing plastic or metal strapping around an object, wherein the strapping is secured to itself around the object at a sealing point and the strapping has a free end extending past the sealing point and not connected at the sealing point, the apparatus comprising:

a pusher tensioner configured to tension the free end of the strapping;

a clamping device mounted to the pusher tensioner and configured to clamp a clamped portion of the strapping between ends of the strapping to be sealed at the sealing point adjacent to the object, wherein the clamping device comprises a clamping plate mounted to define a clamping space between the clamping plate and a portion of the pusher tensioner, wherein at least one of the clamping plate and the portion of the pusher tensioner defines at least one groove facing the clamping space, wherein the at least one groove is sized to receive a ball bearing having a width larger than the groove's depth and larger than the clamping space such that the ball bearing is spaced from a surface opposite the groove to engage the clamped portion of the strapping.

2. The apparatus of claim 1 wherein the groove is sloped to have a declining depth in a direction of shifting of the clamped portion of the strapping during tightening of the strapping such that the shifting of the clamped portion of the strapping forces the ball bearing into a portion of the groove having the declining depth to pinch the clamped portion of the strapping between the ball bearing and the surface opposite the groove.

3. An apparatus for securing plastic or metal strapping around an object, wherein the strapping is secured to itself around the object at a sealing point and the strapping has a free end extending past the sealing point and not connected at the sealing point, the apparatus comprising:

a pusher tensioner configured to tension the free end of the strapping;

a clamping device mounted to the pusher tensioner and configured to clamp a clamped portion of the strapping between ends of the strapping to be sealed at the sealing point adjacent to the object, wherein the pusher tensioner comprises:

a body;

a toothed wheel pivotally mounted in relation to the body;

a lever connected to rotate the toothed wheel in response to the lever's being moved in a first direction relative to the body and to not rotate the toothed wheel in response to the lever's being moved in a second direction relative to the body, the first direction being different from the second direction;

a first receiving plate and a second receiving plate mounted to the body in a spaced relationship to define a space between the first receiving plate and the second receiving plate sized to guide the strapping from a first end of the first receiving plate and the second receiving plate to a second end of the first receiving plate and the second receiving plate, wherein the second end of the first receiving plate and the second receiving plate being opposite from the first end of the first receiving plate and the second receiving plate and spaced relative to the toothed wheel to guide the free end of the strapping to the toothed wheel.

4. The apparatus of claim 3 wherein the clamping device comprises a third plate mounted to define a clamping space between the third plate and the second receiving plate, wherein at least one of the third plate and the second receiving plate defines at least one groove facing the clamping space, wherein the at least one groove is sized to receive a ball bearing having a width larger than the groove's depth and larger than the clamping space such that the ball bearing is spaced from a surface opposite the groove to engage the clamped portion of the strapping.

5. The apparatus of claim 4 wherein the groove is sloped to have a declining depth in a direction of shifting of the clamped portion of the strapping during tightening of the strapping such that the shifting of the clamped portion of the strapping forces the ball bearing into a portion of the groove having the declining depth to pinch the clamped portion of the strapping between the ball bearing and the surface opposite the groove.

6. An apparatus for securing plastic or metal strapping around an object, wherein the strapping is secured to itself around the object at a sealing point and the strapping has a free end extending past the sealing point and not connected at the sealing point, the apparatus comprising:

a pusher tensioner configured to tension the free end of the strapping;

a clamping device mounted to the pusher tensioner and configured to clamp a clamped portion of the strapping between ends of the strapping to be sealed at the sealing point adjacent to the object, the clamping device comprises:

a clamping plate mounted to define a clamping space between the clamping plate and a portion of the pusher tensioner;

a clamping member mounted relative to the clamping space and configured to move between a first position allowing room to place a portion of the strapping in the clamping space and a second position that when the portion of the strapping is in the clamping space clamps the strapping in the clamping space to prevent movement of the strapping relative to the clamping space;

an actuator mounted to move the clamping member between the first position and the second position in response to actuation of the actuator.

7. The apparatus of claim 6 wherein the clamping member comprises a rod mounted to rotate in response to actuation of the actuator, wherein the rod defines an engaging surface disposed on the rod so as to rotate into the clamping space to engage the strapping when the rod moves to the second position.

8. The apparatus of claim 7 wherein the rod is rounded about a portion of its circumference and the engaging surface is defined by a generally flat portion of another portion the rod's circumference.

* * * * *